US006062566A

United States Patent [19]

Lemons

[11] Patent Number: 6,062,566

[45] Date of Patent: May 16, 2000

[54] DOMINOS-STYLE MATHEMATICAL OPERATION GAME

[76] Inventor: Lemuel W. Lemons, 3102 Casa Bonita Dr., Bonita, Calif. 91902

[21] Appl. No.: 09/022,368

[22] Filed: Feb. 12, 1998

[51] Int. Cl.[7] ..... A63F 9/20

[52] U.S. Cl. ..... 273/293; 273/292; 273/296; 434/205; 434/209

[58] Field of Search ..... 434/188, 191, 434/205, 209; 273/296, 293, 292; 463/26

[56] References Cited

U.S. PATENT DOCUMENTS

| | | | |
|---|---|---|---|
| 615,818 | 12/1898 | Dexter . | |
| 1,450,874 | 4/1923 | Strommee | 273/293 |
| 2,198,670 | 4/1940 | Johnson | 434/209 X |
| 2,748,500 | 6/1956 | Cormack | 434/205 |
| 3,345,759 | 10/1967 | Harris | 434/191 X |
| 3,523,377 | 8/1970 | Gardner | 434/209 X |
| 3,680,866 | 8/1972 | Kerr | 273/137 D |
| 4,125,263 | 11/1978 | Hamilton | 273/293 |
| 4,359,227 | 11/1982 | Porciello | 273/268 |
| 4,419,081 | 12/1983 | Steinmann | 434/188 |
| 5,114,344 | 5/1992 | Fumagalli | 434/205 |
| 5,743,741 | 4/1998 | Fife | 434/205 |
| 5,791,988 | 8/1998 | Nomi | 463/11 |

*Primary Examiner*—Richard J. Apley
*Assistant Examiner*—William LaMarca

[57] ABSTRACT

A dominos-style mathematical operation game is provided including a plurality of dominos each having a top face and a bottom face. The bottom face of each domino has a pair of equally sized sides each with a unique combination of a number indicia and a mathematical sign.

7 Claims, 2 Drawing Sheets

DOMINOS-STYLE MATHEMATICAL OPERATION GAME

BACKGROUND OF THE INVENTION

1. Field of the Invention

The present invention relates to dominos and more particularly pertains to a new dominos-style mathematical operation game for providing entertainment while practicing math.

2. Description of the Prior Art

The use of dominos is known in the prior art. More specifically, dominos heretofore devised and utilized are known to consist basically of familiar, expected and obvious structural configurations, notwithstanding the myriad of designs encompassed by the crowded prior art which have been developed for the fulfillment of countless objectives and requirements.

Known prior art dominos include U.S. Pat. No. 5,314,190; U.S. Pat. No. 4,561,658; U.S. Pat. No. 4,673,185; U.S. Pat. No. 5,346,225; U.S. Pat. No. 5,338,203; and U.S. Pat. No. Des. 259,049.

In these respects, the dominos-style mathematical operation game according to the present invention substantially departs from the conventional concepts and designs of the prior art, and in so doing provides an apparatus primarily developed for the purpose of providing entertainment while practicing math.

SUMMARY OF THE INVENTION

In view of the foregoing disadvantages inherent in the known types of dominos now present in the prior art, the present invention provides a new dominos-style mathematical operation game construction wherein the same can be utilized for providing entertainment while practicing math.

The general purpose of the present invention, which will be described subsequently in greater detail, is to provide a new dominos-style mathematical operation game apparatus and method which has many of the advantages of the dominos mentioned heretofore and many novel features that result in a new dominos-style mathematical operation game which is not anticipated, rendered obvious, suggested, or even implied by any of the prior art dominos, either alone or in any combination thereof.

To attain this, the present invention generally comprises a plurality of dominos each having a rectangular configuration with a blank top face and a bottom face. As shown in FIG. 3, the bottom face of each domino has a pair of equally sized sides each with a unique combination of a number indicia and a mathematical sign. Next provided is a unitary starting piece having a cross-shaped configuration with four integrally coupled end square sections. Each section is equipped with a unique combination of a number indicia and a mathematical sign. In the case of both the dominos and the starting piece, the number indicia represents a number between 0–10 and the mathematical sign represents at least one of an addition sign, a subtraction sign, a multiplication sign and a division sign. For reasons that will soon become apparent, a dice is provided including six sides each with a unique number indicia present thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new dominos-style mathematical operation game apparatus and method which has many of the advantages of the dominos mentioned heretofore and many novel features that result in a new dominos-style mathematical operation game which is not anticipated, rendered obvious, suggested, or even implied by any of the prior art dominos, either alone or in any combination thereof.

It is another object of the present invention to provide a new dominos-style mathematical operation game which may be easily and efficiently manufactured and marketed.

It is a further object of the present invention to provide a new dominos-style mathematical operation game which is of a durable and reliable construction.

An even further object of the present invention is to provide a new dominos-style mathematical operation game which is susceptible of a low cost of manufacture with regard to both materials and labor, and which accordingly is then susceptible of low prices of sale to the consuming public, thereby making such dominos-style mathematical operation game economically available to the buying public.

Still yet another object of the present invention is to provide a new dominos-style mathematical operation game which provides in the apparatuses and methods of the prior art some of the advantages thereof, while simultaneously overcoming some of the disadvantages normally associated therewith.

Still another object of the present invention is to provide a new dominos-style mathematical operation game for providing entertainment while practicing math.

Even still another object of the present invention is to provide a new dominos-style mathematical operation game that includes a plurality of dominos each having a top face and a bottom face. The bottom face of each domino has a pair of equally sized sides each with a unique combination of a number indicia and a mathematical sign.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
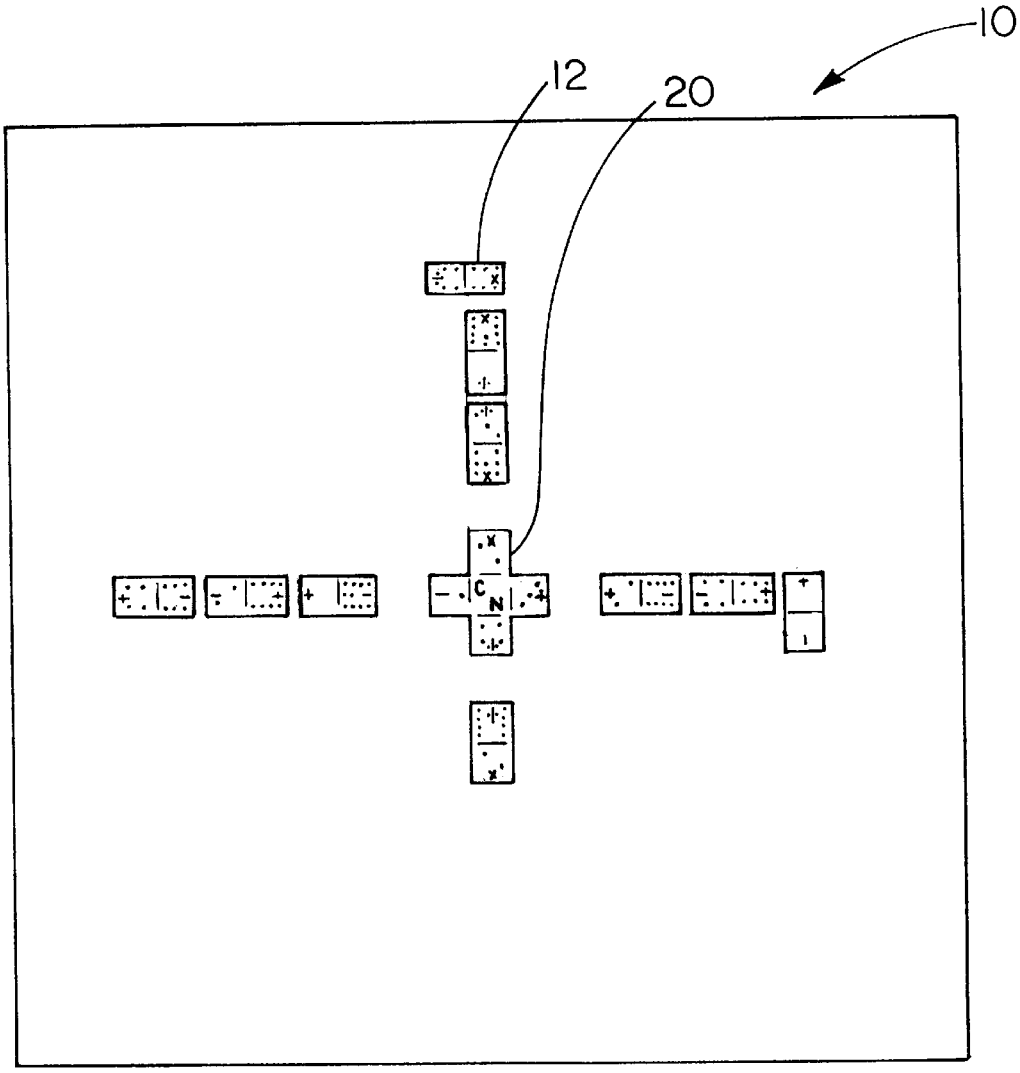
FIG. 1 is a top view of a new dominos-style mathematical operation game according to the present invention.
Figure 2:
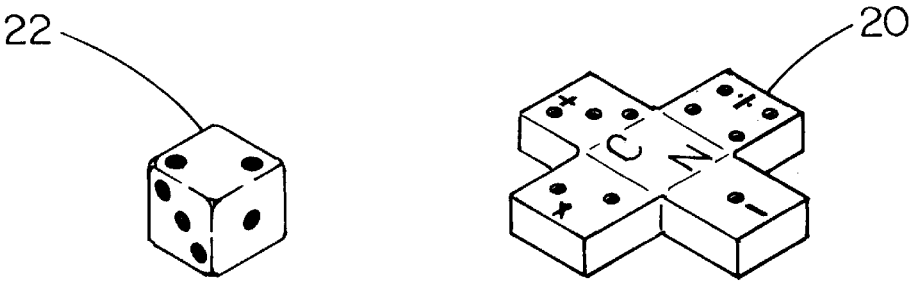
FIG. 2 is a perspective view of both the starting piece and dice of the present invention.
Figure 3:
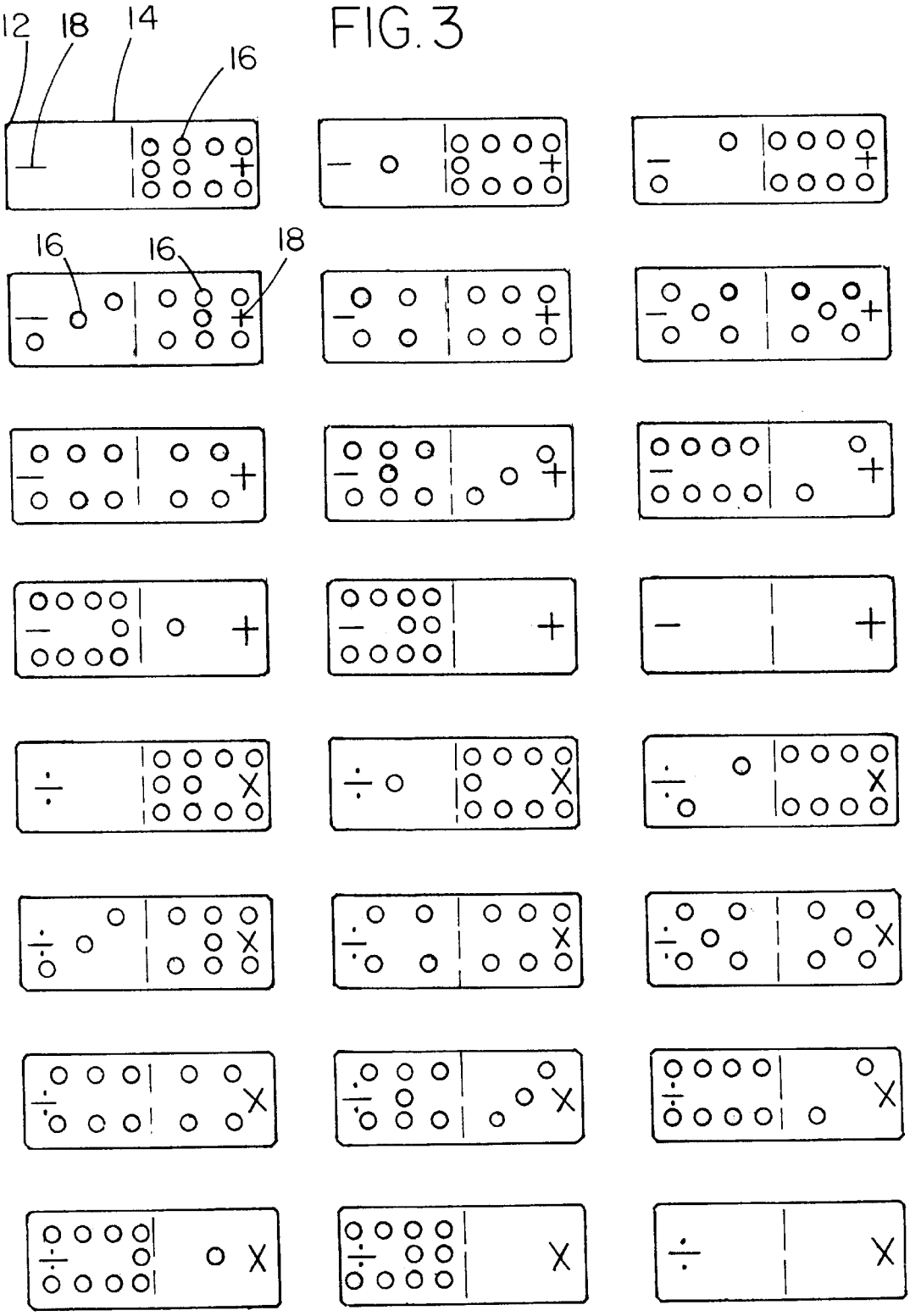
FIG. 3 is a top view of the various domino configurations of the present invention.

With reference now to the drawings, and in particular to FIGS. 1 through 3 thereof, a new dominos-style mathematical operation game embodying the principles and concepts of the present invention and generally designated by the reference numeral 10 will be described.

The present invention, designated as numeral 10, includes a plurality of dominos 12 each having a rectangular configuration with a blank top face and a bottom face. As shown in FIG. 3, the bottom face of each domino has a pair of equally sized sides 14 each with a unique combination of a number indicia 16 in the form of dots and a mathematical sign 18.

Next provided is a unitary starting piece 20 having a cross-shaped configuration with four integrally coupled end square sections. Each section is equipped with a unique combination of a number indicia and a mathematical sign. In the case of both the dominos and the starting piece, the number indicia represents a number between 0–10 and the mathematical sign represents at least one of an addition sign, a subtraction sign, a multiplication sign and a division sign. For reasons that will soon become apparent, a dice 22 is provided including six sides each with a unique number indicia present thereon.

The method associated with the present invention will now be set forth. First, the dominos are situated face down and equally distributed as a function of a number of players. A player who begins play is determined by way of a highest roll of the dice. Next, the starting piece is placed on a playing surface and the players take turns placing the sides or sections of the dominos in contiguous relationship such that the mathematical signs thereof match. The first player receives normal points, as will be set forth, in addition to a "20" point bonus.

During each turn, a first number of points are awarded to the present player. Such points are generated by way of operating on numbers represented by the number indicia of the contiguous sides of the dominos as a function of the mathematical sign. For example, if a pair of addition signs are matched and the numbers are "4" and "2", the first number of points awarded is "6".

In addition to the foregoing points, the players are awarded a second number of points associated with the specific type of matching mathematical signs of the contiguous sides. For example, in the preferred embodiment, matching division signs award "4" points, matching addition signs award "3" points, matching multiplication signs award "2" points and matching subtraction signs award "1" point. As such, in the previous example, the player would receive a total of "9" points. It is preferred that the starting piece show the aforementioned point scheme. Note FIG. 2.

During play, a designated player would be responsible for tallying points on score sheets. In each turn, the player may continue play until no match can be made after which "10" points are deducted. Further, a player who uses all of his or her dominos receives a "25" point bonus. A winner is declared as the player with the highest number of points when the dominos are all played. As an option, further mathematical functions may be employed along with taking into account multiplication of negative numbers for the purposes of providing a more advanced game.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dominos-style mathematical operation game comprising, in combination:

a plurality of dominos each having a rectangular configuration with a blank top face and a bottom face, the bottom face of each domino having a pair of equally sized sides each with a unique combination of a number indicia representing a number between 0–10 and a pair of contrasting mathematical signs from the groups of an addition and a subtraction sign, and a multiplication and a division sign;

a unitary starting piece having a cross-shaped configuration with four square end sections and a square center section between the end sections, each of the square end sections having a unique combination of a number indicia representing a number between 0–10 and a mathematical sign representing at least one of an addition sign, a subtraction sign, a multiplication sign and a division sign; and a dice including six sides each with a unique number indicia present thereon.

2. A dominos-style mathematical operation game comprising:

a plurality of rectangular shaped dominos each having a pair of longer side edges and a pair of shorter end edges, and a top face and a bottom face, the bottom face of each domino having a pair of end sections, each end section having a combination of a number indicia and a pair of contrasting mathematical signs chosen from the groups of an addition and a subtraction sign, and a multiplication and a division sign, one of the contrasting signs being located on one of the end sections and the other one of the contrasting signs being located on the other end section.

3. The dominos-style mathematical operation game as set forth in claim 2 wherein the number indicia represents a number between 0–10.

4. The dominos-style mathematical operation game as set forth in claim 2 and further including a unitary starting piece having a cross-shaped configuration with four integrally coupled end square sections each with a combination of a number indicia and a mathematical sign.

5. The dominos-style mathematical operation game as set forth in claim 2 and further including a dice.

6. A method of playing a dominos-style mathematical operation game comprising the steps of:

providing a plurality of rectangular shaped dominos each having a pair of longer side edges and a pair of shorter end edges, and a top face and a bottom face, the bottom face of each domino having a pair of equally sized end sections, each end section having a unique combination of a number indicia and a pair of contrasting mathematical signs chosen from the groups of an addition and a subtraction sign, and a multiplication and a division sign, one of the contrasting signs being located on one of the end sections and the other one of the contrasting signs being located on the other end section;

placing the end edges of two of the dominos in contiguous relationship such that the mathematical signs of the end sections of the contiguous dominos match; and awarding a number of points generated by way of operating on numbers represented by the number indicia of the contiguous sides as a function of the mathematical sign.

7. The method of playing a dominos-style mathematical operation game as set forth in claim 6 and further including the step of awarding a number of points associated with the specific type of matching mathematical signs of the contiguous sides.

* * * * *